United States Patent [19]

Pallanch

[11] Patent Number: 4,660,384

[45] Date of Patent: Apr. 28, 1987

[54] DEFROST APPARATUS FOR REFRIGERATION SYSTEM AND METHOD OF OPERATING SAME

[75] Inventor: Francis T. Pallanch, St. Louis Park, Minn.

[73] Assignee: VILTER Manufacturing, Inc., Milwaukee, Wis.

[21] Appl. No.: 855,741

[22] Filed: Apr. 25, 1986

[51] Int. Cl.[4] ..... F25B 41/00; F25D 21/06

[52] U.S. Cl. ..... 62/81; 62/151; 62/196.3; 62/196.4; 62/278; 62/510

[58] Field of Search ..... 62/278, 277, 196.4, 62/238.6, 335, 510, 79, 81, 151, 196.3

[56] References Cited

U.S. PATENT DOCUMENTS

| | | | |
|---|---|---|---|
| 3,138,007 | 6/1964 | Friedman et al. | 62/278 |
| 3,838,582 | 10/1974 | Redfern et al. | 62/278 X |
| 3,869,874 | 3/1975 | Ditzler | 62/510 X |
| 4,083,195 | 4/1978 | Kramer et al. | 62/196.4 |

*Primary Examiner*—Harry B. Tanner

*Attorney, Agent, or Firm*—James E. Nilles; Thomas F. Kirby; Nicholas A. Kees

[57] ABSTRACT

A refrigeration system, and a method for operating the system, having a two-stage compressor for supplying refrigerant to a cooling coil, and having a desuperheater unit disposed between the two compressor stages. This desuperheater unit includes a container having heat exchange fluid therein and a coil, disposed in the heat exchange fluid, through which the refrigerant passes. During normal operation of the refrigeration system, both compressors are running. The desuperheater unit between the two compressor stages reduces the temperature of the compressed refrigerant before it reaches the second stage. The temperature of the heat exchange fluid is correspondingly increased in the course of the heat exchange. Also during normal operation, frost accumulates on the cooling coil, which is removed by a control device initiating a defrost cycle. When the defrost cycle begins, the first stage compressor is turned off while the second stage compressor continues to run. Flow of refrigerant is then diverted making the desuperheater coil an evaporator coil, providing load for the second stage compressor, while the cooling coil becomes the condenser. Thus, during the defrost cycle, the heat exchange fluid is cooled while the cooling coil is heated and defrosted. After defrost is completed, the flow of refrigerant is normalized, with the cooling coil again cooled and the heat exchange fluid again heated.

10 Claims, 2 Drawing Figures

DEFROST APPARATUS FOR REFRIGERATION SYSTEM AND METHOD OF OPERATING SAME

BACKGROUND OF THE INVENTION

This invention relates to the operation of refrigeration systems having self-defrosting apparatus, and in particular to operating such systems so that part of the system collects waste energy during the normal operation thereof to be used at the time defrost is required.

Prior refrigeration systems often have used an outside energy source to effect defrosting when that became necessary due to accumulation of frost or ice on the cooling coils of the system. This is particularly true in plants that have only one freezer, since no other load exists to aid in defrosting the freezer coils. Some systems have used electric resistance heating, which is very expensive and inefficient in the current energy-conscious environment. Other systems have used a separate air unit in the heated space as a load to generate hot gas for use on defrost. While effective, this is not much more efficient or cost effective than electric resistance defrost.

Another approach has been to attempt to split or zone the cooling coils and defrost one part thereof at a time using the energy generated by the rest of the cooling coils, still in the cooling mode. This is difficult to carry out and not very effective because so much air is moving through the freezer that the overall temperature thereof may be raised. To avoid this effect, dampers would have to be used to isolate the portion of the coil being defrosted from the others not being defrosted. Such dampers have been found to be not very dependable. Alternatively, if the refrigeration system is being employed in a line-type application, the defrost must be done during a break period, when the product flow has stopped. This procedure may not be satisfactory since the line may not need to be stopped for any other reason than periodic defrost if it runs continuously. Further, even if the defrost operation is conducted during a break period, use of one coil as a load to defrost another may not be satisfactory since, without product load, the coil not being defrosted may not provide sufficient heat to defrost the other coil.

A defrosting device with a heat extractor or reservoir is disclosed in Redfern, U.S. Pat. No. 3,838,582. That system however is a single stage system, having only one compressor therein. Further, two separate coils are disposed in the energy reservoir. A need exists for a two stage system, and a system that makes more efficient use of materials.

This invention relates to improvements over the apparatus referred to above, as well as to solutions to the problems raised thereby.

SUMMARY OF THE INVENTION

The invention is embodied in a refrigeration system having a two-stage compressor for supplying compressed refrigerant to a cooling coil. Disposed between the two stages of the compressor is a desuperheater unit containing a heat exchange fluid. Means are provided to operate the system in a refrigeration mode wherein the cooling coil is cooled, and at the same time the heat exchange fluid is heated. Means are also provided to operate the system in a defrost mode, wherein the cooling coil is heated so as to melt any ice or frost accumulated thereon, by use of the heat which has built up in the heat exchange fluid. In particular, the desuperheater unit includes a container for the heat exchange fluid and a coil, disposed in the heat exchange fluid, through which the refrigerant passes. During normal operation of the refrigeration system, both compressors operate to compress the refrigerant and, by the usual means, cool the cooling coil. The desuperheater unit located between the two stages of the compressor serves to reduce the temperature of the refrigerant before it reaches the second stage, thereby improving the efficiency of the system. At the same time, the temperature of the heat exchange fluid is increased in the course of the heat exchange. Periodically a defrost cycle is initiated by control means. When the defrost cycle begins, the first stage of the compressor is turned off, while the second stage continues to run. Flow of the refrigerant is altered so that the desuperheater coil becomes an evaporator coil, providing a load for the second stage of the compressor, with the cooling coil becoming a condenser so that it is defrosted. Thus the heat exchange fluid is cooled while the cooling coil is defrosted. After defrost is completed, the flow of refrigerant is returned to normal, so that the cooling coil is again cooled and the heat exchange fluid is again heated.

It is thus an object of the invention to provide a two stage refrigeration system having a defrost apparatus which collects heat during the normal cooling operation, and uses that heat to accomplish the defrost function.

Another object of the invention is to provide a refrigeration system as described above wherein some of the heat removed from the refrigerated space is collected in a heat exchange fluid disposed in the system between the two stages of the compressor of the system.

A more specific object of the invention is to provide a refrigeration system as described above wherein a desuperheater coil is disposed in the heat exchange fluid for heating the fluid during the normal operation of the system, and for cooling the fluid during the defrost operation, so that most of the energy used during the defrost operation is recovered during normal operation.

Another specific object of the invention is to provide a refrigeration system as described above wherein the first stage of the two stage compressor is turned off during the defrost operation so as not to add further heat to the heat exchange fluid during that operation.

Other objects and advantages of the invention will become apparent hereinafter.

DESCRIPTION OF THE PREFERRED EMBODIMENTS

Figure 1:
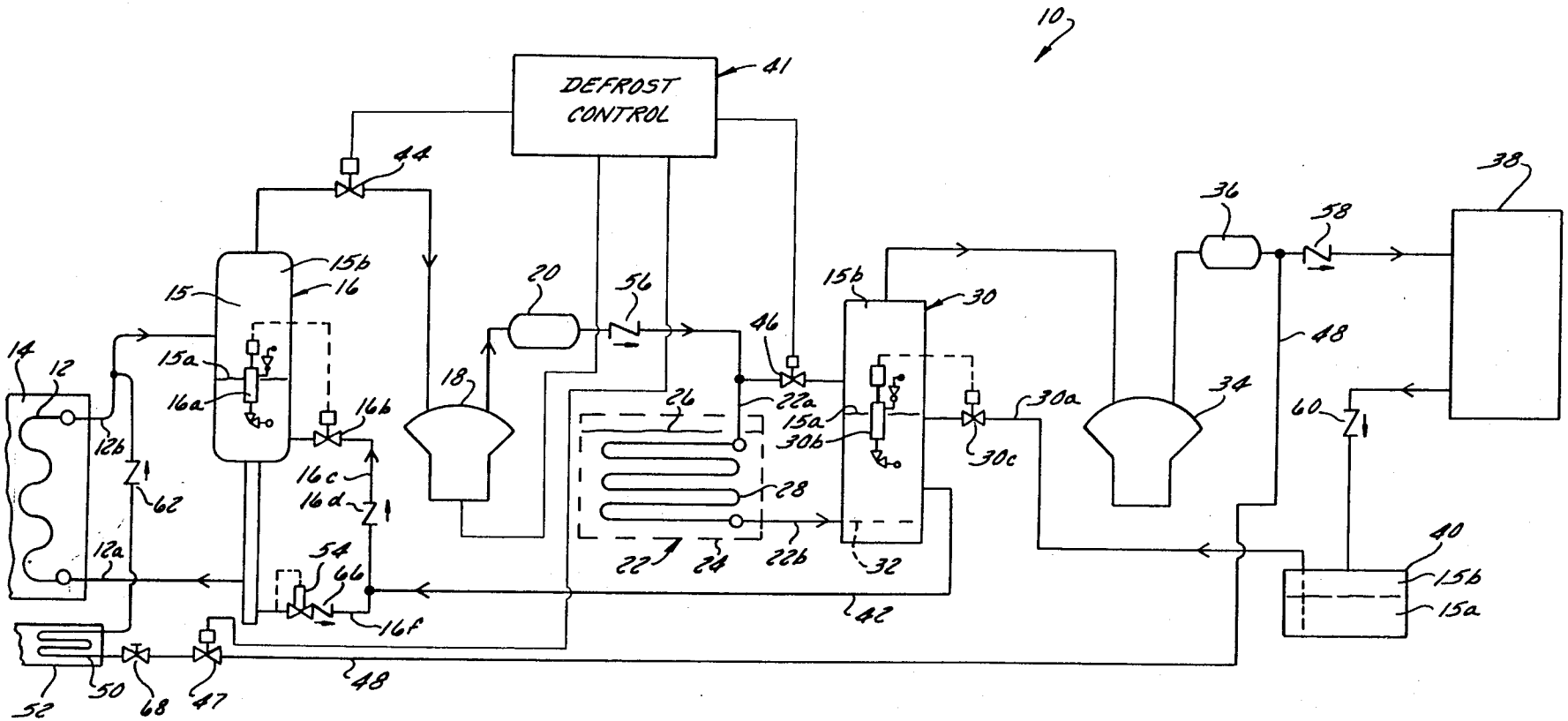
FIG. 1 is a schematic diagram of a refrigeration system according to the invention, with arrows showing the flow of refrigerant during normal operation, there being no arrows in lines where there is no flow during normal operation.
Figure 2:
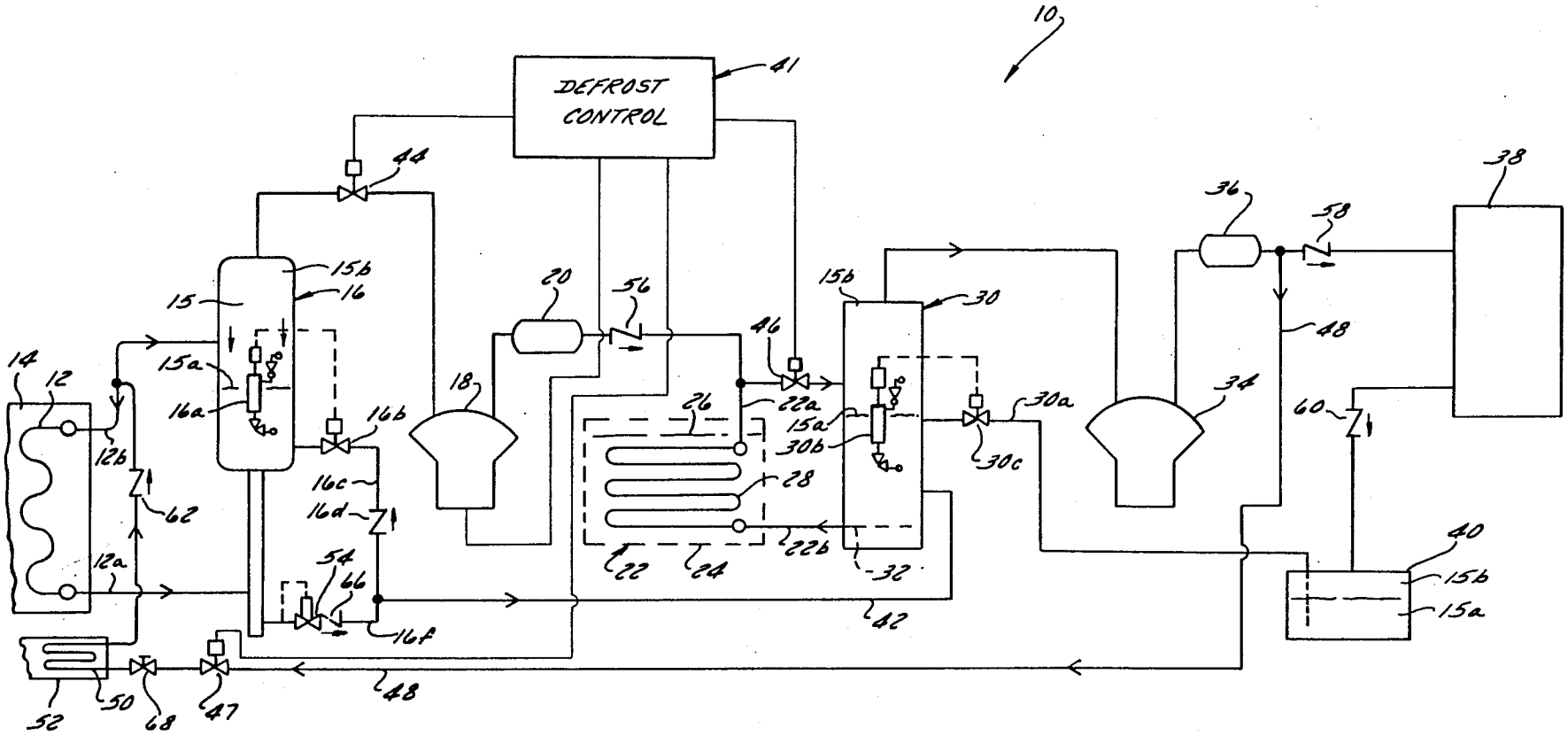
FIG. 2 is a schematic diagram of the system shown in FIG. 1, with arrows showing the flow of refrigerant during the defrost operation, there being no arrows in lines where there is no flow during the defrost operation.

Referring now to FIG. 1, a refrigeration system 10 is constructed according to the invention. In that figure, arrows are used to show the flow of refrigerant during normal operation, there being no arrows in lines where there is no flow during normal operation. In general, the system 10 includes a cooling coil 12 for cooling a refrigerated space 14. During refrigeration, cooling coil 12 is supplied with refrigerant by a first stage compressor 18 and a second stage compressor 34, via a condenser 38 and an intercooler 30. A heat exchange means or desuperheater 22 containing heat exchange fluid 26 is located between the two compressor stages 18 and 34, for cooling the refrigerant in a coil 28 located therein as the refrigerant leaves the first stage 18. The heat which thus builds up in the heat exchange fluid 26 is then removed on defrost and used to defrost the cooling coil 12, as shown in FIG. 2, by changing the flow of refrigerant so that it bypasses first stage compresser 18 and condenser 38 and flows to cooling coil 12 while still hot from the second stage compressor 34, in effect heating the cooling coil 12 and cooling the heat exchange fluid 26.

In particular, the normal or cooling mode of operation of the system 10 will be described in detail first in conjunction with the detailed description of the main part of the apparatus of the system. Thereafter the operation of the system in its defrost mode will be described in detail.

NORMAL MODE

As referred to above, the system 10 includes cooling coil 12 which cools the refrigerated space 14. As is usually the case in such refrigeration systems, liquid refrigerant 15*a* enters via an inlet line 12*a* at the bottom of the coil 12 and exits via an outlet line 12*b* at the top thereof expanded, in partially liquid and partially gaseous form. From there the refrigerant 15 passes to an accumulator 16 for separation of the gaseous portion 15*b* from the liquid portion 15*a*. The level of liquid refrigerant 15*a* in accumulator 16 is maintained at or just above the top of coil 12 so as to maintain proper cooling. This maintenance of the refrigerant level in accumulator 16 is accomplished by a float switch 16*a* located therein, which in turn controls a valve 16*b* in the accumulator inlet line 16*c*. A check valve 16*d* may also be provided in accumulator inlet line 16*c* so as to prevent backflow of refrigerant in the inlet line 16*c*. From the accumulator 16, the gaseous portion 15*b* of the refrigerant 15 continues into the first stage compressor 18 where it is compressed and, to an extent, heated thereby. After exiting and passing through an oil separator 20, it continues into the desuperheater 22 and particularly the inlet line 22*a* thereof, where it is cooled to an extent. In the preferred embodiment, the desuperheater 22 includes a tank 24 having a certain amount of heat exchange fluid 26 contained therein. The gaseous refrigerant 15*b* from first stage compressor 18 passes through a coil 28 disposed in the heat exchange fluid 26. The heat from the compressed refrigerant warms the heat exchange fluid 26 while the refrigerant itself is further cooled. The preferred heat exchange fluid 26 is water, because it is inexpensive, widely available and has a high thermal transfer coefficient, particularly upon freezing and thawing, although other heat transfer fluids such as ethylene glycol may also be employed as long as they have similar properties.

From an outlet line 22*b* of desuperheater 22, the gaseous refrigerant 15*b* continues into a flash intercooler 30 preferably by means of a sparge pipe 32, where the refrigerant is further cooled and condensed as it bubbles up through the liquid refrigerant 15*a* stored therein. From there the gaseous portion 15*b* of the refrigerant continues on to second stage compressor 34, where it is again compressed and heated to an extent. From the second stage compressor 34, the refrigerant passes through another oil separator 36 and into a condenser 38, where it is cooled and condensed into liquid form. The liquid refrigerant 15*a* is then passed into a receiver 40 for storage. From the receiver 40, the liquid refrigerant 15*a* next passes through the intercooler 30 via inlet line 30*a* to further cool the outlet gaseous refrigerant from the first compressor stage 18. The level of liquid refrigerant 15*a* in intercooler 30 is maintained in a similar manner to the way the level is maintained in accumulator 16. A float switch 30*b* located in intercooler 30 controls a valve 30*c* in the inlet line 30*a* to ensure that the level of liquid refrigerant 15*a* in the intercooler 30 remains proper. From there the liquid refrigerant 15*a* continues, via a refrigerant line 42 and accumulator inlet 16*c*, through the accumulator 16 and into the inlet line 12*a* at the bottom of the coil 12 to complete the cycle.

DEFROST MODE

As referred to above, during the normal refrigeration operation, hot gaseous refrigerant 15*b* discharged from the first stage compressor 18 is first routed through the desuperheater 22 before continuing to complete the cycle, thereby warming the heat exchange liquid 26 contained therein. Also as referred to above, frost tends to build up on cooling coil 12 during normal operation of the system 10. Referring now to FIG. 2, here again arrows are used to show the flow of refrigerant during the defrost operation, there being no arrows in lines where there is no flow during the defrost operation. Defrost control means 41 are provided to initiate a defrost cycle. This defrost control means 41 may include timer means (not shown) to initiate the cycle strictly on a periodic basis from time to time. It may include a sensor means (not shown) for initiating the defrost cycle upon the detection of a predetermined amount of frost. Or it could include a combination of any one or more of these along with any other suitable control means.

Referring now to FIG. 2, on defrost, control means 41 shuts off the first stage compressor 18. At the same time, control means 41 opens a normally closed valve 46 connected between the desuperheater inlet 22*a* and the intercooler 30, diverting the flow of refrigerant 15 and allowing it to flow upward through the desuperheater 22 and into the intercooler 30. Simultaneously, control means 41 closes valve 44 to prevent flow of refrigerant to first stage compressor 18 from accumulator 16 during defrost. Effectively the desuperheater 22 has become an evaporator and the intercooler 30 has become an accumulator for it. From intercooler 30, the gaseous portion 15*b* of the refrigerant is drawn into the second stage compressor 34, where it is compressed and heated. After the compressor drives it through the oil separator 36, the refrigerant enters a branch line 48, effectively bypassing the condenser 38. This bypass occurs because control means 41 has also opened a valve 47 in the line 48, near the coil 12, at the same time as valve 46 was opened and valve 44 was closed, allowing flow of gaseous refrigerant 15*b* in line 48 without flowing first to condenser 38. In addition, the compressed gaseous refrigerant 15*b* exiting the second stage compressor 34 naturally tends to flow towards the lowest pressure. Since the pressure in the coil 12 will be low, nearly atmospheric, while the pressure in the condenser 38 will be substantially higher, up to several hundred psi, the refrigerant will follow line 48 and bypass condenser 38.

The line 48 leads first to a coil 50 located in a pan 52 disposed underneath the cooling coil 12. The purpose of pan 52 is to catch runoff water as it melts and drips off of the coil 12. The purpose of coil 50 in pan 52 is to keep this drip off water from refreezing before it can be drained away. From pan coil 50, some of the hot gaseous refrigerant 15*b* continues into main cooling coil 12 to melt any ice or frost accumulated thereon. The refrigerant 15*b* enters at the outlet line 12*b* of coil 12, and exits at the inlet line 12*a* at the bottom thereof. The balance of the hot gaseous refrigerant 15*b* passes into the accumulator 16 above the liquid level. In both cases the entering refrigerant 15*b* is gaseous and under high pressure, while the liquid refrigerant 15*a* is cool and under lower pressure. Thus as gaseous refrigerant 15*b* enters, it exerts downward pressure on the liquid refrigerant 15*a* in both coil 12 and accumulator 16 and increases the internal pressure in both. When the pressure reaches a predetermined level, such as 70 psi, a valve 54 in an accumulator outlet line 16*f* opens and allows liquid refrigerant 15*a* to flow from the line 12*a* of coil 12 and from the bottom 16*e* of accumulator 16 back to intercooler 30 via line 42. The high pressure gaseous refrigerant 15*b* continues to flow into the cooling coil and accumulator 16, defrosting the coil 12, as the liquid refrigerant 15*a* flows out the bottom of both. Notice that the flow of refrigerant 15 through cooling coil 12, accumulator 16 and line 42 is reversed during the defrost operation compared to the direction of flow during normal operation as described above.

From the intercooler 30 the refrigerant 15 passes to the desuperheater coil 28 via the sparge pipe 32 and desuperheater outlet 22*b*, and passes upward through the coil 28 therein to complete the cycle. Hence the direction of flow of refrigerant through desuperheater 22 is also reversed. Depending upon the details of the defrost control means 41, when a sufficient time has passed, or when frost is no longer sensed on cooling coil 12, or when other suitable conditions are met, valves 46 and 47 are closed, valve 44 is opened and first stage compressor 18 is started up again to resume the normal cooling operation.

Thus the heat exchange fluid 26 in desuperheater 22 acts as an energy reservoir, being heated during the normal cooling operation and cooled during the defrost operation. By this means, a substantial portion of the energy used to defrost the cooling coil 12 is recovered from the fluid 26 during the normal cooling operation. This feature in a two stage compressor system, in combination with the reversal of flow of refrigerant so as to allow the use of only one coil in the heat exchange fluid, are advantages not known in systems existing heretofore.

There may be check valves provided at certain points in the system so as to assure proper direction of flow of refrigerant at those points. In particular, a check valve 56 is provided between first stage compressor 18 and desuperheater 22 to make sure that no refrigerant flows into the compressor from the desuperheater on defrost. Another check valve 58 is provided at the inlet of the condenser 38 to prevent flow of refrigerant from the condenser into the line 48 during defrost. Another check valve 60 is provided at the outlet of the condenser 38 to ensure that refrigerant flows into the receiver 40 properly. Yet another check valve 62 is provided between pan coil 50 and cooling coil 12 to prevent backflow of cool refrigerant during normal cooling operation of the system, and still allow hot refrigerant to flow from pan coil 50 to cooling coil 12 on defrost. Finally, check valve 66 is provided in accumulator lines 16*f*. Valve 66 prevents flow of refrigerant into the accumulator 16 during normal cooling operation by any other route than through control valve 16*b*.

In addition, a control valve 68 may be provided in line 48 to regulate the flow of refrigerant in line 48 when valve 47 first opens. If valve 47 opens too suddenly, damage could be caused to the system, since the pressure in line 48 will generally be high. Keeping valve 68 partially closed will prevent all of this pressure from being released all at once, thereby preventing damage to the system.

While the apparatus hereinbefore described is effectively adapted to fulfill the aforesaid objects, it is to be understood that the invention is not intended to be limited to the particular preferred embodiments of defrost apparatus for spiral refrigeration system herein set forth. Rather, it is to be taken as including all reasonable equivalents without departing from the scope of the appended claims.

I claim:

1. In a refrigeration system:

a cooling coil having an inlet line and an outlet line;

an accumulator for receiving refrigerant discharged from said cooling coil outlet line;

a desuperheater comprising a container of heat exchange liquid and a desuperheater coil disposed therein, which desuperheater coil has an inlet line and an outlet line;

a flash intercooler for receiving cooled refrigerant from said desuperheater coil outlet line;

a first stage compressor for receiving and compressing refrigerant from said accumulator and for supplying it to said desuperheater coil inlet line whereby said heat exchange liquid in said tank is heated;

a second stage compressor for receiving and compressing refrigerant from said intercooler;

a condenser for receiving compressed refrigerant from said second stage compressor, condensing it, and supplying it to said inlet line of said cooling coil to effect cooling of said cooling coil;

and means to defrost said cooling coil comprising:

means to shut off said first stage compressor;

means to divert refrigerant to flow from said intercooler in reverse direction through said desuperheater coil and back to said intercooler;

means to supply heated refrigerant from said second stage compressor to said cooling coil outlet line, and;

means to return condensed refrigerant from said cooling coil inlet line to said accumulator, and then back to said intercooler.

2. A system according to claim 1 wherein said means to divert heated refrigerant comprises valve means connected between said desuperheater coil inlet line and said intercooler.

3. A system according to claim 2 further comprising means, disposed beneath said cooling coil, for catching melted frost and ice as it drips from said cooling coil, wherein said means for supplying heated refrigerant to said cooling coil also supplies heated refrigerant to said catching means so as to prevent said melted frost and ice from refreezing therein before it is drained from said catching means.

4. A system according to claim 3 wherein said heat exchange fluid is water.

5. In a refrigeration system comprising a first stage compressor and a second stage compressor, a desuperheater comprising a heater coil and body of heat exchange fluid associated therewith, a flash intercooler, a condenser and a cooling coil:

means to operate said system in a refrigeration mode wherein said heater coil receives refrigerant from said first stage compressor and supplies said refrigerant through said flash intercooler to said second stage compressor for recirculation thereby through said condenser, said flash intercooler and said cooling coil and back to said first stage compressor, said body of heat exchange fluid operating to absorb heat from said heater coil during said refrigeration mode;

and means to selectively and alternately operate said system in a defrosting mode wherein said heater coil receives refrigerant from said cooling coil and supplies said refrigerant through said flash intercooler to said second stage compressor for recirculation of heated refrigerant through said cooling coil and back to said heater coil, said body of heat exchange fluid operating to transfer heat to said heater coil during said defrosting mode.

6. A system according to claim 5 further comprising means, disposed beneath said cooling coil, for catching melted frost and ice as it drips from said cooling coil, wherein said compressor, besides supplying heated refrigerant to said cooling coil, also supplies heated refrigerant to said catching means so as to prevent said melted frost and ice from refreezing therein before it is drained from said catching means.

7. A system according to claim 6 wherein said heat exchange fluid is water.

8. A method of operating a refrigeration system to alternately effect refrigeration and defrosting, said system comprising a first stage compressor, a second stage compressor, a desuperheater including a heater coil and a body of heat exchange fluid, a flash intercooler, a condenser, and a cooling coil which tends to accumulate frost, said method comprising the steps of:

directing refrigerant from said first stage compressor through said heater coil, through said flash intercooler, through said second stage compressor, through said condenser, through said cooling coil and back to said first stage compressor, whereby said cooling coil effects refrigeration and accummulates frost and whereby said heater coil transfers heat to said body of heat exchange fluid;

and subsequently directing refrigerant from said second stage compressor through said cooling coil, through said heater coil, through said flash intercooler and back to said second stage compressor, whereby said body of heat exchange fluid transfers heat to said heater coil and to said refrigerant therein and whereby the refrigerant transfers heat to said cooling coil to effect melting of frost thereon.

9. A method according to claim 8 further comprising means, disposed beneath said cooling coil, for catching melted frost and ice as it drips from said cooling coil, wherein said compressor, besides supplying refrigerant to said cooling coil on defrost, also supplies refrigerant to said catching means on defrost so as to prevent said melted frost and ice from refreezing therein before it is drained from said catching means.

10. A system according to claim 9 wherein said heat exchange fluid is water.

* * * * *